US006015582A

United States Patent [19]

Kageyama et al.

[11] Patent Number: 6,015,582

[45] Date of Patent: Jan. 18, 2000

[54] WATER ABSORBING ARTICLE AND METHOD OF USING THE SAME

[75] Inventors: Yohei Kageyama; Takeshi Banba; Eikichi Kogure, all of Kawasaki, Japan

[73] Assignee: Showa Denko K.K., Tokyo, Japan

[21] Appl. No.: 09/081,614

[22] Filed: May 20, 1998

[30] Foreign Application Priority Data

| | | | |
|---|---|---|---|
| May 20, 1997 | [JP] | Japan | 9-129832 |
| May 20, 1997 | [JP] | Japan | 9-129833 |
| May 20, 1997 | [JP] | Japan | 9-129834 |

[51] Int. Cl.[7] ..... B65D 81/26

[52] U.S. Cl. ..... 426/392; 426/106; 426/124; 426/129; 426/132; 426/410; 206/204

[58] Field of Search ..... 426/106, 124, 426/129, 132, 392, 410; 206/204; 604/378, 381, 382

[56] References Cited

U.S. PATENT DOCUMENTS

| | | | |
|---|---|---|---|
| 4,802,574 | 2/1989 | Akiba | 206/204 |
| 5,055,332 | 10/1991 | Rhodes et al. | 426/124 X |
| 5,176,930 | 1/1993 | Kannankeril et al. | 426/129 X |
| 5,250,310 | 10/1993 | Fujino et al. | 426/129 X |
| 5,552,169 | 9/1996 | Kannankeril et al. | 426/129 X |
| 5,709,897 | 1/1998 | Pearlstein | 426/129 X |

FOREIGN PATENT DOCUMENTS

| | | |
|---|---|---|
| 9057601 | 5/1991 | Australia . |
| 07257657 | 10/1995 | Japan . |

*Primary Examiner*—Milton Cano
*Attorney, Agent, or Firm*—Sughrue, Mion, Zinn, Macpeak & Seas, PLLC

[57] ABSTRACT

A water absorbing article and method of using the same are provided in order to remove drip accumulated at the interface of a food and an water absorbing article and to prevent foods from quality degradation. The water absorbing article comprises a water absorbing sheet comprising at least three layers; a liquid permeable layer made of paper or pulp, a water absorbing layer made of paper or pulp containing water absorbing particles, and a liquid-in permeable layer inserted in between the liquid permeable layer and the water absorbing layer, and the water absorbing sheet is inserted in a bag made of a liquid permeable sheet. The object is attained by placing a food on a liquid permeable layer of the thus-formed water absorbing article and subsequently the whole is vacuum packed. Furthermore, it was also advantageous to prepare a water absorbing article which is prepared by sealing a water absorbing sheet, both surfaces of which have different water absorbing capacities and to apply a method of placing the food on a surface with low water absorbing capacity and vacuum packaging the whole.

9 Claims, 1 Drawing Sheet

WATER ABSORBING ARTICLE AND METHOD OF USING THE SAME

BACKGROUND OF THE INVENTION

1. Field of the Invention

The present invention relates to a water absorbing article for absorbing and retaining water, and more particularly relates to a water absorbing article and method of using the same which is applicable to a wide range of application fields, such as, for example, preservation of perishable foods such as fish or meat, sanitary material for paper diapers or sanitary napkins, and soil engineering for absorbing and retaining water in a soil for use in agriculture or civil engineering.

2. Background Art

When foods such as fish or meat are stored in a vacuum hermetically sealed packaging at chilled temperatures, meat Juices or broth, called "drip" will exude when the foods are thawed after storage. The drip will accumulate at an interface between foods and the packing film, and the accumulated drip will degrade the quality of the food by causing discoloration or color change and reduces the value of the product. If the discolored portion is removed, the total yield of the food is reduced. In addition, the accumulated drip may foster the growth of bacteria, which results in shorter storage life.

In order to solve the above problems, a method is proposed in Japanese Patent Application, First Publication No. Hei 3-147739, wherein a food is stored by being placed on a liquid absorbing material supported in between a liquid permeable sheet and a liquid absorbing sheet and by vacuum packing the whole with a hermetic film. An alternative method is disclosed in Japanese Patent Application, First Publication No. 7-257657, wherein a food is placed in contact with a film which is semi-liquid-permeable.

However, when the former method is applied, since the food is in contact with a liquid impermeable sheet, it is difficult to remove drip accumulated under concave bottom areas of the food, so that the former method is insufficient for absorbing and removing the undesirable drip.

On the other hand, when the latter method is adopted, since the food is in contact with the semi-permeable film, a drawback was observed in that water in the food was excessively absorbed through the semi-permeable film during storage, thereby, drying the food and the quality of the food was degraded.

The present invention is carried out to solve the above problems. The objects of the present invention are to provide a liquid absorbing article and a method of storing foods by using the same, which is capable of preventing foods from discoloration and color-change for a long period and to prevent foods from drying by absorbing only the drip during storage without actively absorbing water, to remove drip accumulated at concave bottom areas of food.

SUMMARY OF THE INVENTION

Inventors of the present invention have found through research that the above objects can be attained by controlling the amount of water absorbed from the contact area of the food, and the present invention was accomplished based on the above knowledge. The present invention comprises three embodiments which can be used alone or in combinations of two or more.

The first embodiment of the present invention provides a first water absorbing article and a method of using the same.

The first water absorbing article is formed by packing and sealing a water absorbing sheet in a bag made of a liquid-permeable sheet and the water absorbing sheet comprises at least three layers of sheets; that is, a liquid permeable layer made of paper or pulp, a water absorbing layer made of paper or pulp containing particles of a water absorbing agent, and a liquid permeable layer inserted between the above liquid permeable layer and the water absorbing layer. A method of using the present water absorbing article comprises the steps of placing the food on a side of the liquid permeable layer, and vacuum-packing the whole including the food and the water absorbing article.

The second embodiment of the present invention provides a second water absorbing article and a method of using the same. The second water absorbing article is a laminate sheet formed by sealing at peripheries of first and second outer layers composed of liquid permeable sheets including a periphery of a partition layer sandwiched between the first and second outer layers, and a sheet made of paper or pulp is inserted between first outer layer and the partition layer and a sheet made of paper or pulp containing particles of the water absorbing agent is inserted between the second outer layer and the partition layer. The method of using the second water absorbing article comprises the steps of, placing the food on a side of the article which is low in water absorbing capacity and vacuum packing the whole.

The third embodiment of the present invention provides a third water absorbing article and a method of using the same. The third water absorbing article is formed by sealing the periphery of two outer water permeable sheets and a water absorbing sheet is inserted therebetween, wherein one surface of the water absorbing sheet is partially covered by a liquid impermeable material to reduce the water absorbing capacity to be lower than that of the other surface. The method of using the third water absorbing article comprises the steps of placing the food on a surface of the article, the water absorption capacity of which is reduced, and vacuum packing the whole.

DETAILED DESCRIPTION OF THE PREFERRED EMBODIMENTS

Figure 1:
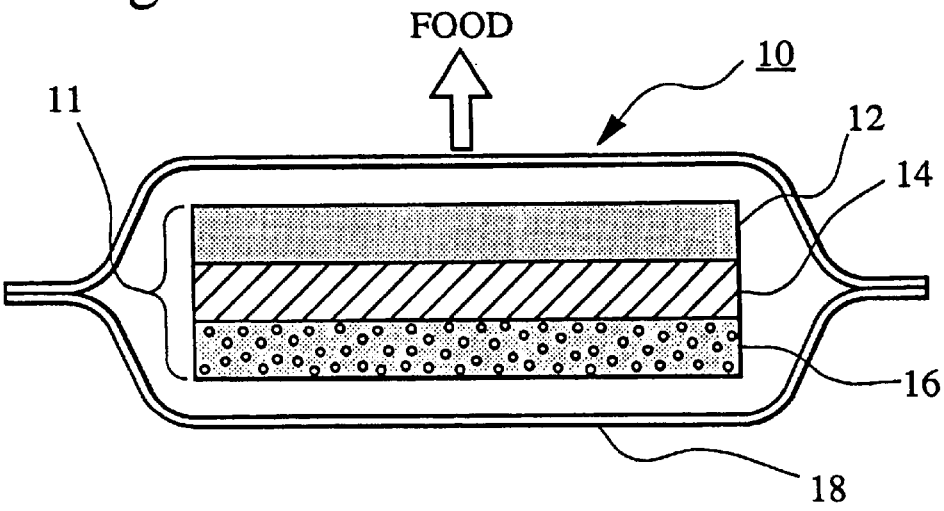
FIG. 1 shows a structure of the water absorbing article and the method of using the same according to the first embodiment of the present invention.

Water absorbing articles of the present invention will be described hereinafter referring to the drawings.

FIG. 1 shows a structure of the first water absorbing article according to the first embodiment of the present invention. Reference numeral 10 designates the first water absorbing article, which comprises a water absorbing sheet 11 composed of a liquid permeable layer 12, a liquid impermeable layer 14, and a liquid absorbing layer 16. That is, the water absorbing sheet 11 is composed of the liquid permeable layer 12 made of paper or pulp, a liquid impermeable layer 14, and the water absorbing layer 16 made of paper or pulp incorporating particles of a water absorbing agent, in the above order.

The first water absorbing article 10 is formed by inserting the water absorbing sheet 11 into a bag formed by a liquid permeable sheet 18.

Any conventional paper or pulp applied in these fields may be used as the liquid permeable layer of the water absorbing article without any limitation.

The water absorbing layer 16 is composed of paper or pulp containing particles of a water absorbing agent.

Any types of water absorbing agents may be used without any limitation, if it is in granular form and used in the fields of paper diapers, sanitary napkins and soil engineering.

The water absorbing particles are generally constructed by three-dimensionally cross-linking water soluble compounds and many types of water soluble compounds are known. Examples of such water soluble compounds are cross-linked polymer products obtained by graft polymerization or obtained by hydrolysis of the polymers after the graft polymerization of polysaccharides, such as starch or cellulose, with at least one compound selected from the group consisting of oligomers or co-oligomers of acrylic acid, methacrylic acid, acrylate salt, methacrylate salt, acrylate ester, methacrylate ester, acrylate amide, methacrylate ester, acrylonitrile, methacrylonitrile, maleic acid, sulfonated styrene, and polyvinylpyridine; cross-linked products of at least one compound selected from the group consisting of polyethylene oxide, polypropylene oxide, polyvinylpyrrolidone, sulfonated polyethylene, polyvinylpyridine, polyacrylate salt, polymethacrylate salt, polyacrylateamide, and polymethacrylateamide; copolymers of vinyl acetate/acrylate salt, isobutylene/maleic anhydride, and polyvinylalcohol/maleic acid; and a cross-linked product of carboxymethylcellulose. Among all these products, cross-linked products of poly(sodium acrylate) are preferable.

The water absorbing layer 16 is formed by incorporating particles of the water absorbing agent by the following methods into paper or pulp. That is, the water absorbing layer is formed by inserting the water absorbing particles between two pulp sheets and subsequent pressing, by mixing particles of the water absorbing agent with dried and crushed pulp fibers and by subsequent rolling, and by incorporating the water absorbing particles with wet formed pulp fibers and subsequent dry rolling.

As the liquid impermeable sheet 14 used in the water absorbing sheet 11, any sheet comprising, for example, synthetic resin films such as polyethylene or polypropylene films, water proof processed papers, and aluminum foils, may be used without limitation, if the sheet is not permeable to liquid.

Papers, nonwoven cloths, and perforated films may be used as the liquid permeable sheet 18 to encapsulate the water absorbing sheet 11.

The water absorbing article 10 according to the present invention is thus formed by inserting the water absorbing sheet 11 formed by three layers into a bag made of the liquid permeable sheet 18, and sealing the periphery of the bag. After placing the food on a surface of the liquid permeable layer 12 of the water absorbing article 10, the whole is vacuum packed for transportation or storage.

When the water absorbing article 10 according to the first embodiment of the present invention is used for storage or transportation of foods, particularly meat or fish, drip exuded from the foods will accumulate on the liquid impermeable layer 14 after passing the liquid permeable layer 12, drip flow on the liquid impermeable layer to flow down to the rear side of the liquid impermeable layer 14 from the periphery of this layer 14 and absorbed by the water absorbing layer 16 which is isolated from the food. The drip is thus absorbed by the water absorbing layer 16 which is isolated from the food so that the food is preserved in a state free from the drip and the food is protected from drying, since the drip absorbing layer exists on the opposite side of the food against the liquid impermeable layer.

Figure 2:
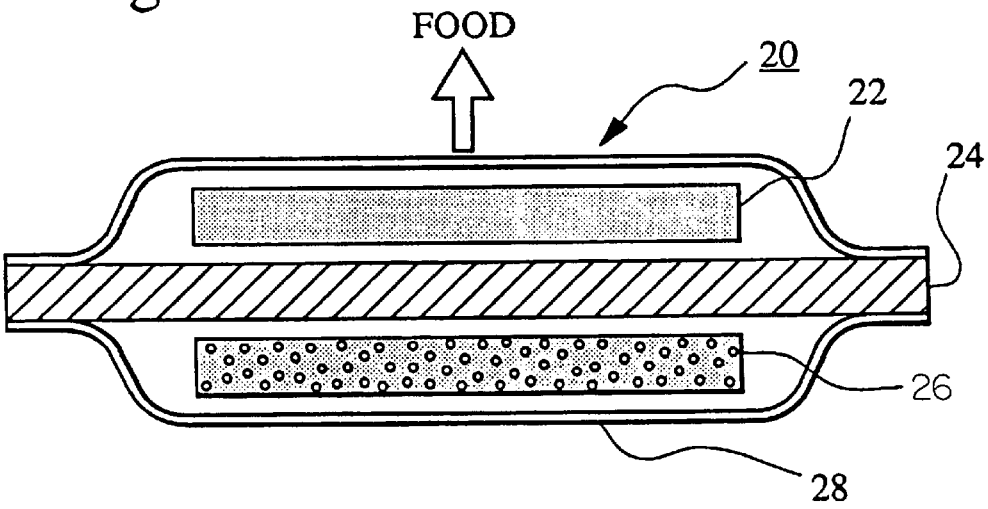
FIG. 2 shows a structure of the water absorbing article and the method of using the same according to the second embodiment of the present invention.

FIG. 2 shows a second water absorbing article 20 according to the second embodiment of the present invention. The second water absorbing article 20 of the second embodiment is formed by inserting a liquid impermeable layer 24 as a partition layer between first and second outer layers 28 and 28 made of liquid permeable sheets and by sealing at the periphery of the outer layers including the edge of the partition layer, wherein a sheet 22 made of paper or pulp is inserted between the partition layer 24 and first outer layer, and a liquid absorbing layer 26 is inserted between the partition layer 24 and second outer layer and is made of papers or pulps containing water absorbing particles.

The sheets 22, 26 and the liquid impermeable sheet 24 used in this embodiment are all made of the same materials as those used for liquid permeable layer 12, water absorbing layer 16 and the liquid impermeable layers 14 used in the first embodiment.

A method of using the water absorbing article according to the second embodiment of the present invention, as shown in FIG. 2, comprises steps of placing a food on the surface side of the sheet 22, and vacuum packing the whole including the food for transportation or storage. Practical examples of producing the water absorbing article and methods of using the same will be described hereinafter in Example 2. By utilizing the article 20 and method of using the same, the same effects are obtained as those obtained by the article 10 and the method according to the first embodiment.

Figure 3:
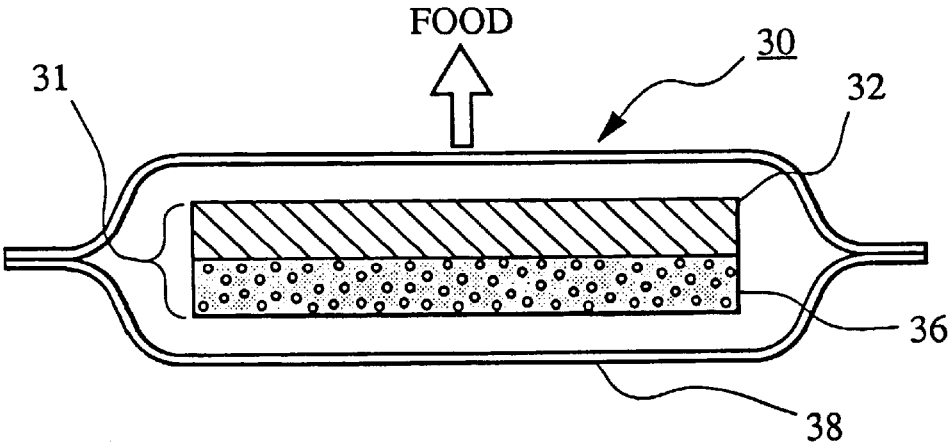
FIG. 3 shows a structure of the water absorbing article and the method of using the same according to the third embodiment of the present invention.

FIG. 3 shows a third water absorbing article 30 according to the third embodiment of the present invention. This third water absorbing article 30 is obtained by inserting a water absorbing sheet 31 in a bag formed by a liquid permeable sheet 38. The water absorbing sheet 31 is formed by water absorbing layer 36, made of paper or pulp, which contains the water absorbing particles. Wherein, on one surface of a water absorbing sheet, a partially coated layer 32 is formed by coating a water insoluble wax or a water insoluble paint or a thermoplastic resin in a lattice form so as to leave about 10% of the surface area without coating. The partially coated layer 32 reduces the water absorbing capacity of one of the surface of water absorbing sheet 31, and this layer 32 is used for a surface to be in contact with foods.

By forming such a structure, the surface of the layer 32 in contact with the food will not actively absorb water from the food and the drip from the food will pass the layer 32 and then flow down to the underlying layer 36 to be absorbed therein; thereby, the food is maintained free from drip.

The present invention will be described hereinafter in more detail referring to the Examples.

EXAMPLE 1

Preparation of the water absorbing sheet: Particles of a commercially available water absorbing agent AQUALIC® CAW4, cross-linked poly (sodium acrylate, produced by Nihon Syokubai Kagaku Co.) were uniformly scattered on a surface of a commercially available tissue paper cut into a size of 10 cm×10 cm. On the scattered particles, a low density polyethylene film (thickness: 30 $\mu$m) of the same size as the tissue paper was then placed, and further the polyethylene film was covered with the same tissue paper of the same size (hereinafter, the surface of the tissue paper which does not contain the water absorbing particles is referred to as the A surface). The thus-obtained laminate sheets were then hot-pressed to obtain a water absorbing sheet.

Fabrication of the water absorbing article: Two unwoven cloth sheets (HOP-30H, produced by Hirose Seisi Co.) cut into a size of 15 cm×15 cm were prepared as the outer water permeable sheets. The above water absorbing sheet was inserted between two unwoven cloth sheets and then four peripheral sides of the outer sheets containing the water absorbing sheet is sealed by heat to fabricate the first water absorbing article.

Application test: 3 kg of a round beef from Australia was placed on the A surface of the first water absorbing article. Then the whole was put in a bag made by polyethylene film (thickness: 60 $\mu$m), and vacuum sealed.

The thus obtained package was placed in an refrigerator and retained at 2° C. for three weeks. The package was then taken out from the refrigerator and a weight gain of the water absorbing article was measured and the beef surface preserved in contact with the article and the article preserved in contact with the beef were visually observed. The results of the test was shown in Table 1.

EXAMPLE 2

A low density polyethylene film with a size of 15 cm×15 cm was sandwiched between two wet unwoven cloth sheets of the size of 15 cm×15 cm, and three peripheral sides were hot-sealed to obtain a bag in which a partition of the low density polyethylene film was inserted. In one side of the bag (hereinafter, refer to as the "a-side"), a tissue paper with a size of 10 cm×10 cm was inserted, and in the other side of the bag (refer to as the "b-side"), a liquid absorbing sheet was inserted, which was formed by sandwiching 1 g of water absorbing particles (Aquaric CAW4, produced by Nihon Syokubai Kagaku Co.) scattered between two tissue papers to obtain the second water absorbing article.

3 kg of the round beef from Australia was placed on the a-side surface of the second water absorbing article, and after vacuum packaging, the package was placed in an refrigerator and retained at 2° C. for three weeks. The package was then taken out from the refrigerator and the weight gain of the article was measured and both interfaces of the food and the article were visually observed. The test result was shown in Table 1.

EXAMPLE 3

1 g of water absorbing particles (Aquaric CAW4, produced by Nihon Syokubai Kagaku Co.) were scattered and sandwiched between two tissue papers of a size of 10 cm×10 cm and press-formed by a press machine. On one side of the pressed sheet, an epoxy adhesive was coated in a lattice form so as to leave 10% of the area uncovered to obtain a water absorbing sheet. This water absorbing sheet was sandwiched between two wet unwoven cloth sheets (HOP-30H, produced by Hirose Seisi Co.) with a size of 15 cm×15 cm, and four sides of the covering cloth sheets were heat-sealed to obtain the third water absorbing article.

The low water absorbing side (the side coated by an epoxy adhesive) was made to be in contact with the bottom surface of the round beef (3 kg) from Australia, and after vacuum packaging, the package was placed in an re frigerator and retained at 2° C. for three weeks. After three weeks, the vacuum package was unpacked, and the weight gain of the water absorbing article was measured and the food surface and the interface of the article preserved in contact with the beef was visually observed. The test result was shown in Table 1.

Comparative Example 1

A bag was prepared by heat sealing three sides of a laminate of two wet unwoven clothes and a low density polyethylene film sandwiched in between said two clothes. A water absorbing sheet was prepared by scattering 1 g of the water absorbing particles on a tissue paper with a size of 10 cm×10 cm and covering the scattered surface with a tissue paper of the same size so as to sandwich the water absorbing particles between two tissue papers and then adhered by a press machine . The thus prepared water absorbing sheet was inserted in said bag and a side of the bag remained open was heat sealed to f of a comparative water absorbing article. A polyethylene film side of the comparative water absorbing article was made to contact with a bottom surface of a round beef (3 kg) from Australia. The same tests were carried out by the same method as that of Example 1.

Comparative Example 2

The same water absorbing article was obtained except adopting a unwoven cloth instead of the low density polyethylene film, and the same tests were carried out as shown in the Examples.

The test results were summarized in Table 1.

| | WEIGHT GAIN OF WATER ABSRBING ARTICLE | STATE OF FOOD SURFACE* | STATE OF CONTACT SURFACE |
|---|---|---|---|
| EXAMPLE 1 | 101.2 | GOOD | GOOD |
| EXAMPLE 2 | a-side 16.5<br>b-side 72.1 | GOOD | GOOD |
| EXAMPLE 3 | 97.3 | GOOD | GOOD |
| COMPARATIVE EXAMPLE 1 | 78.4 | GOOD | DRIP ACCUMULATED |
| COMPARATIVE EXAMPLE 2 | 130.5 | GOOD | DISCOLORED |

The present invention provides an advantageous water absorbing article, which, when removing drip exuded from foods such as meat or fish, is capable of absorbing only drip without actively absorbing water from the food, preventing discoloration or color-change for a long period by removing drip accumulated at the interface of the food and the water absorbing article, and thereby, avoiding loss of food.

What is claimed is:

1. A water absorbing article for absorbing drip exuded from food, comprising:

a water absorbing sheet comprising at least three layers comprising a liquid permeable layer formed by paper or pulp, a water absorbing layer formed by paper or pulp containing scattered particles of a water absorbing agent, and a liquid impermeable layer placed between said liquid permeable layer and said water absorbing layer;

wherein said water absorbing sheet is placed in a bag formed by a liquid permeable sheet.

2. A water absorbing article according to claim 1, wherein said liquid permeable sheet is formed by paper, an unwoven cloth, or a perforated film.

3. A method of using a water absorbing article for absorbing drip exuded from food said method comprising the steps of:

placing a food on a liquid permeable layer side of the water absorbing article of claim 1; and vacuum packing the food and the water absorbing article, with an air impermeable sheet.

4. A water absorbing article for absorbing drip exuded from food comprising:

a sealed laminate comprising first and second outer layers each made of a liquid permeable sheet, and a partition layer made of a liquid impermeable sheet and inserted between said first and second outer layers; and a sheet made of paper or pulp inserted between said partition layer and the first outer layer, and a sheet made of paper or pulp containing particles of a water absorbing agent inserted between said partition layer and the second outer layer.

5. A water absorbing article according to claim 4, wherein said liquid permeable sheet is formed by a material selected from a group consisting of paper, unwoven cloth, a perforated film.

6. A method of using a water absorbing article for absorbing drip exuded from food said method comprising the steps of:

contacting a food with a side of the water absorbing article of claim 4 containing the sheet made of paper or pulp; and subsequently vacuum packing the food and the water absorbing article.

7. A water absorbing article for absorbing drip exuded from food comprising:

first and second outer layers made of liquid permeable sheets; and a water absorbing sheet placed between said first and second outer layers, comprising a partially coated layer and a liquid absorbing layer containing water absorbing particles, a surface of one of the livers the water absorbing sheet having a water absorbing capacity different from the other;

wherein said first and second outer layers are sealed at a periphery thereof.

8. A water absorbing article according to claim 7, wherein said liquid permeable sheet is formed by a material selected from a group consisting of paper, an unwoven cloth, and a perforated film.

9. A method of using a water absorbing article for absorbing drip exuded from food the method comprising the steps of:

placing a food on a surface of the water absorbing article of claim 7 having the lower water absorbing capacity; and vacuum packing the food and the water absorbing article.

* * * * *